US008665109B2

(12) United States Patent
Partouche

(10) Patent No.: US 8,665,109 B2
(45) Date of Patent: Mar. 4, 2014

(54) WIRED DRILL PIPE CONNECTION FOR SINGLE SHOULDERED APPLICATION AND BHA ELEMENTS

(75) Inventor: Ashers Partouche, Richmond, TX (US)

(73) Assignee: Intelliserv, LLC, Houston, TX (US)

( * ) Notice: Subject to any disclaimer, the term of this patent is extended or adjusted under 35 U.S.C. 154(b) by 508 days.

(21) Appl. No.: 12/556,147

(22) Filed: Sep. 9, 2009

(65) Prior Publication Data

US 2011/0057810 A1 Mar. 10, 2011

(51) Int. Cl.
*G01V 3/00* (2006.01)

(52) U.S. Cl.
USPC ..... 340/854.4; 340/853.2; 370/254

(58) Field of Classification Search
USPC ..... 340/854.2, 854.3, 854.4, 854.5
See application file for complete search history.

(56) References Cited

U.S. PATENT DOCUMENTS

| | | | | |
|---|---|---|---|---|
| 6,208,586 | B1 * | 3/2001 | Rorden et al. | 367/35 |
| 6,641,444 | B2 | 11/2003 | Hanazaki et al. | |
| 6,670,880 | B1 | 12/2003 | Hall et al. | |
| 6,844,498 | B2 | 1/2005 | Hall et al. | |
| 7,193,526 | B2 | 3/2007 | Hall et al. | |
| 7,201,240 | B2 * | 4/2007 | Hall et al. | 175/320 |
| 7,413,021 | B2 | 8/2008 | Madhavan et al. | |
| 7,668,118 | B2 * | 2/2010 | Johnson et al. | 370/254 |
| 8,049,506 | B2 * | 11/2011 | Lazarev | 324/333 |
| 2009/0045973 | A1 * | 2/2009 | Rodney et al. | 340/853.2 |
| 2010/0071188 | A1 * | 3/2010 | Madhavan et al. | 29/428 |

* cited by examiner

*Primary Examiner* — Peguy Jean Pierre
(74) *Attorney, Agent, or Firm* — Conley Rose, P.C.

(57) ABSTRACT

A method and apparatus for transmitting data across a tool joint connection. In one embodiment, the system includes a first data transmission element connected to a first downhole component, a second data transmission element connected to a second downhole component, and a biasing element biasing at least one of the first and second data transmission elements towards the other data transmission element such that the first and second data transmission elements are in data communication with each other.

21 Claims, 13 Drawing Sheets

WIRED DRILL PIPE CONNECTION FOR SINGLE SHOULDERED APPLICATION AND BHA ELEMENTS

BACKGROUND OF THE INVENTION

1. Field of the Invention

Embodiments of the present invention generally relate to downhole telemetry systems, and more particularly to wired drill pipe that conveys data and/or power between one or more downhole locations within a borehole and the surface.

2. Description of the Related Art

For the past several decades, engineers have worked to develop apparatuses and methods to effectively transmit information from components located downhole on oil and gas drilling strings to the ground's surface. Part of the difficulty of this problem lies in the development of reliable apparatus and methods for transmitting information from one drill string component to another, such as between sections of drill pipe. The goal is to provide reliable information transmission between downhole components stretching thousands of feet beneath the earth's surface, while withstanding hostile wear and tear of subterranean conditions.

Measurement While Drilling (MWD) and Logging While Drilling (LWD) systems derive much of their value from the ability to provide real-time information about downhole conditions near the drill bit. Oil companies use these downhole measurements to make decisions during the drilling process, e.g., to provide input or feedback information for sophisticated drilling techniques such as the GeoSteering system developed by Schlumberger. Such techniques rely heavily on instantaneous knowledge of many variables such as characteristics of the formation that is being drilled, weight on drill bit, depth, azimuth, drill speed, drill penetration rate, bit whirl, drill bit location within the formation, downhole pressure, downhole temperature, etc. Accordingly, the industry continues to develop new real-time (or near real-time) measurements capabilities, including imaging-type measurements with high data content and bit rate.

In an effort to provide solutions to this problem, engineers have developed a technology known as mud pulse telemetry. Data transmission between downhole and surface locations with mud pulse telemetry involves using the drill string is used to convey modulated acoustic waves in the drilling fluid. Data transmission rates using mud-pulse telemetry lie in the range of 1-6 bits/second. Such slow rates are incapable of transmitting the large amounts of data that are typically gathered with a LWD string. Additionally, in some cases (e.g., when using foamed drilling fluid), mud-pulse telemetry does not work at all. As a result, it is not uncommon for some or all of the data collected by MWD/LWD systems to be stored in downhole memory and downloaded when the systems return to the surface. This delay significantly reduces the value of the data for real-time or near real-time applications. Also, there is a significant risk of data loss, for example, if the MWD/LWD tool(s) are lost in the borehole.

Moreover, at the slow data rate mud-pulse telemetry offers, data resolution is typically poor, preventing a driller from making crucial decisions in real time. Since drilling equipment is often rented and very expensive, even slight mistakes incur substantial expense. Part of the expense can be attributed to time-consuming operations that are required to retrieve downhole data or to verify low-resolution data transmitted to the surface by mud pulse telemetry. Often, drilling or other procedures are halted while crucial data is gathered.

In an effort to overcome limitations imposed by mud pulse telemetry systems, reliable connections are needed to transmit information between components in a drill string. As a result, a number of new and/or modified telemetry techniques for use with current MWD/LWD systems as well as other real time data collection systems have been proposed or attempted with varying degrees of success.

For example, a new telemetry system having a communication channel within drill pipe, often referred to as wired drill pipe ("WDP"), has been proposed. WDP has a cable with a coupler at each joint, such as a magnetic inductive coupler disclosed in U.S. Pat. Nos. 6,670,880 and 6,844,498. Another such system using a toroidal inductive coupler has been disclosed in U.S. Pat. Nos. 6,641,434 and 7,413,021. However, these systems rely on double shouldered premium tool joint connections, where a primary external and secondary internal shoulder are load bearing shoulders and resist the stresses associated with high torque make up of tool joints. This is due in part to the targeted market for WDP such as extended reach wells that require high connection torque and thus the premium connection tool joints. Additionally, some of the WDP systems require high contact pressure for best efficiency and the internal shoulder is one of the positions that house various components of WDP systems.

However, the high torque requirement sometimes is only necessary in the drill pipe section of a drill string, where the bottom hole assembly (BHA) section may require standard API torques. Various downhole components located in the BHA may include LWD tools, drill collars, and jars. Additionally, many types of drill pipe and drilling applications simply do not need premium tool joint connections and are only required to handle standard API torques. Most of these types of applications have non-double shouldered tool joints, and thus no shoulder to house some of the components used in WDP systems. Many of the elements located in the BHA section of the drill string as well as repeaters located throughout the drill string utilize non-double shouldered connections. Thus, there is a need to connect WDP having double shouldered connections to WDP having single shouldered connections.

SUMMARY OF THE INVENTION

In one embodiment a system for transmitting data across a tool joint connection is provided where the system includes a first data transmission element connected to a first downhole component and a second data transmission element connected to a second downhole component, and a biasing element biasing at least one of the first and second data transmission elements towards the other data transmission element such that the first and second data transmission elements are in data communication with each other.

In another embodiment, a system for transmitting data across a tool joint connection includes a first downhole component having a threaded pin end, a first data transmission element located in the pin end, a second downhole component having a threaded box end, a chassis disposed within the second downhole component proximate the box end, a annular extension extending from the chassis, the annular extension located radially between an inner diameter of the box end and an outer diameter of the pin end; and a second data transmission element located on the inside diameter of the annular extension; wherein the first data transmission element and the second data transmission element are in data communication with each other when the pin end and the box end are joined.

In another embodiment, a method of transmitting data across a tool joint connection is provided where the method includes connecting a first data transmission element to a first downhole component, connecting a second data transmission element to a second downhole component, biasing the second data transmission element towards the first transmission element, and transmitting data between the first and second data transmission elements.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present invention provide downhole telemetry systems and methods for transmitting data across a tool joint connection, such as a single shouldered tool joint.

It should be noted that "wired drill pipe" or "WDP" means one or more tubular members, including drill pipe, drill collars, hybrid drill pipe, heavy weight drill pipe, reamers, and other tubulars, that are adapted for use in a drill string, with each tubular member comprising a wired link.

It should be noted that "single shouldered" means a tool joint connection that has one load bearing shoulder.

It should be noted that "double shouldered" means a tool joint connection that has two load bearing shoulders.

Figure 1:
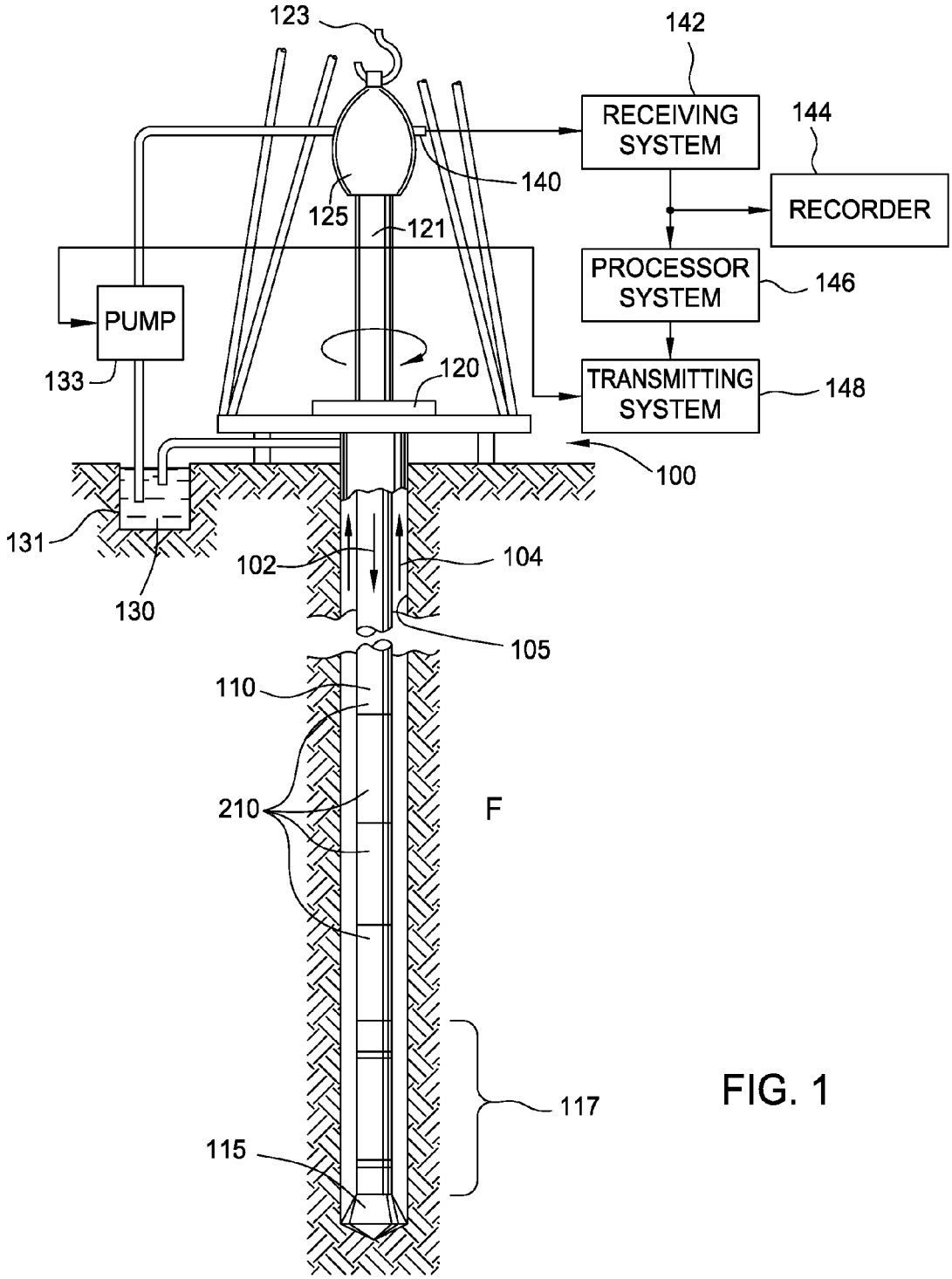
FIG. 1 depicts a schematic representation of a downhole telemetry system in use on a drilling rig.

Referring to the drawings, FIG. 1 depicts a schematic representation of a downhole telemetry system in use on a drilling rig, such as a top drive or rotary table type drilling rig, an example of which is illustrated in FIG. 1. As shown in FIG. 1, a platform and derrick assembly 100 is positioned over a borehole 105 penetrating a subsurface formation F. A drill string 110 is suspended within the borehole 105 and includes a drill bit 115 at its lower end. The drill string 110 is rotated by a rotary table 120, energized by means not shown, which engages a kelly 121 at the upper end of the drill string. The drill string 110 is suspended from a hook 123, attached to a traveling block (not shown), through the kelly 121 and a rotary swivel 125 which permits rotation of the drill string relative to the hook.

The drill string 110 may otherwise employ a "top-drive" configuration (also well known) wherein a power swivel rotates the drill string instead of a kelly joint and rotary table. Those skilled in the art will also appreciate that "sliding" drilling operations may otherwise be conducted with the use of a well known Moineau-type mud motor that converts hydraulic energy from the drilling fluid 130 pumped from the pit 131 down through the drill string 110 into torque for rotating a drill bit. Drilling may furthermore be conducted with so-called "rotary-steerable" systems which are known in the related art. The various aspects of the present invention are adapted for employment in each of these drilling configurations and are not limited to conventional rotary drilling operations.

Drilling fluid 130, sometimes referred to as "mud", is stored in a pit 131 formed at the well site. A mud pump 133 delivers drilling fluid 130 to the interior of the drill string 110 via a port (not shown) in the swivel 125, inducing the drilling fluid to flow downwardly through the drill string 110 as indicated by directional arrow 102. The drilling fluid subsequently exits the drill string 110 via ports in the drill bit 115, and then circulates upwardly through the region between the outside of the drill string and the wall of the borehole, called the annulus, as indicated by direction arrows 104. In this manner, the drilling fluid lubricates the drill bit 115 and carries formation cuttings up to the surface as the drilling fluid is returned to the pit 131 for screening and recirculation.

The drill string 110 further includes a bottom hole assembly (BHA) 117 disposed near the drill bit 115. The BHA 117 may include capabilities for measuring, processing, and storing information, as well as for communicating with the surface. The communication signal from the BHA 117 may be received at the surface by a transducer 140, which is coupled to an uphole receiving system 142. The output of the receiving system 142 is in communication with a processor 146 and a recorder 144. The system may further include a transmitting system 148 for communicating with the downhole instruments.

The drill string 110 may utilize a wired telemetry system wherein multiple WDP joints 210 are interconnected as part of the drill string. The drill string 110 may have a portion that uses WDP pipes along with other types of telemetry systems. For example, a telemetry system may include WDP in combination with MWD or LWD type telemetry systems. Data transmission elements may be located at each end of a WDP and are used to transmit a signal across WDP joints, examples of which include inductive couplers, non-toroidal inductive couplers, flux couplers, direct connect couplers, or any component for transmitting data across tool joints.

Figure 5:
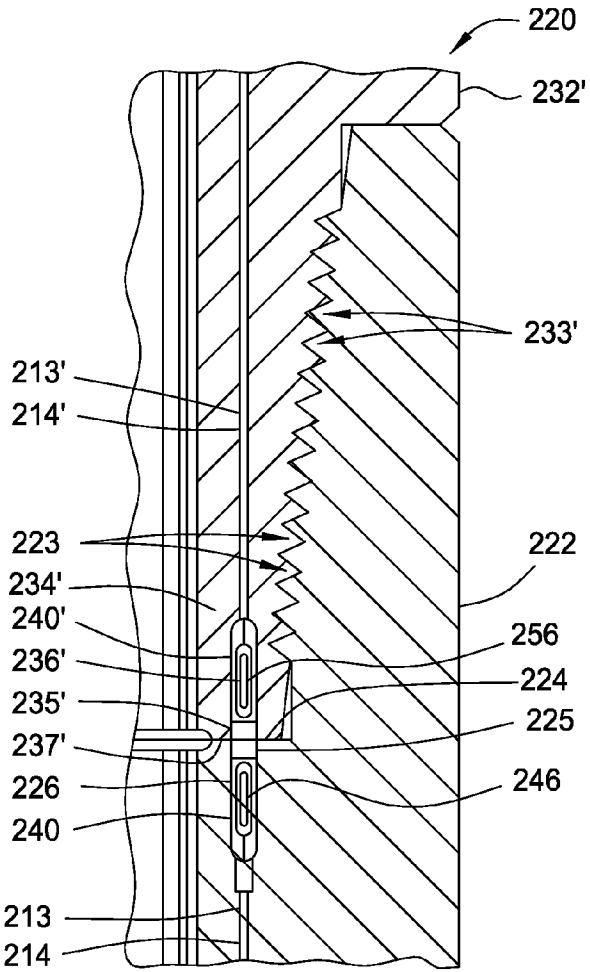
FIG. 5 depicts a sectional view of a pair of data transmission elements facing each other in a pair of double shouldered drill pipe connected together as part of a drill string.
Figure 3:
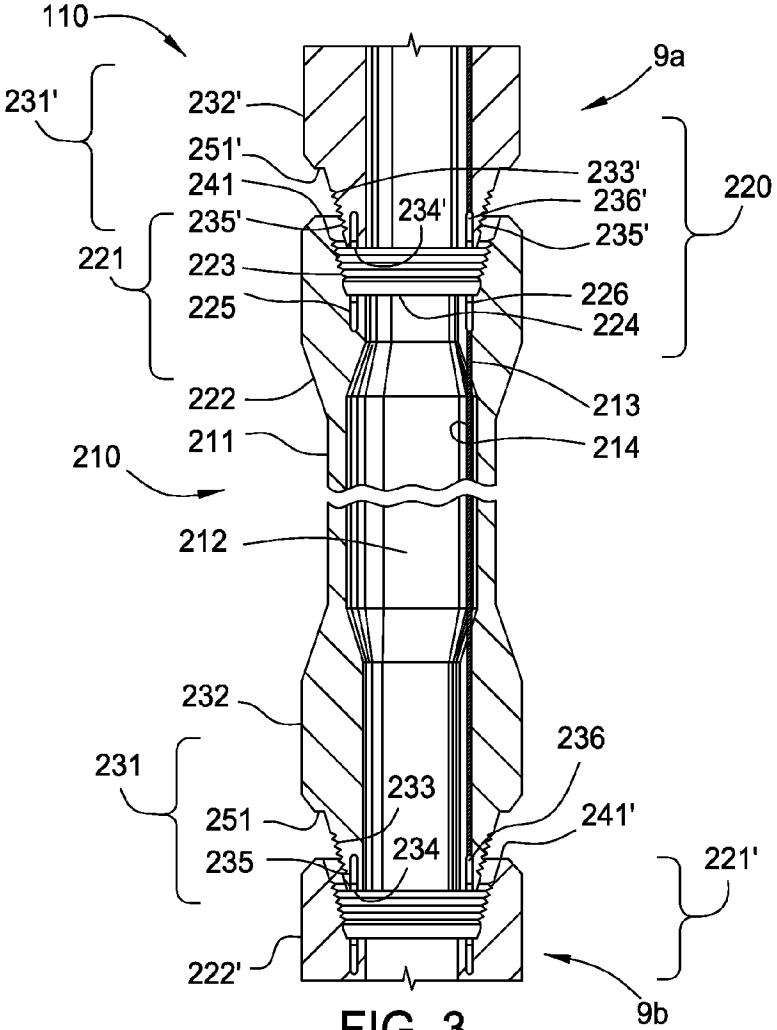
FIG. 3 depicts a cross-sectional view of WDP connected in a drill string.
Figure 4:
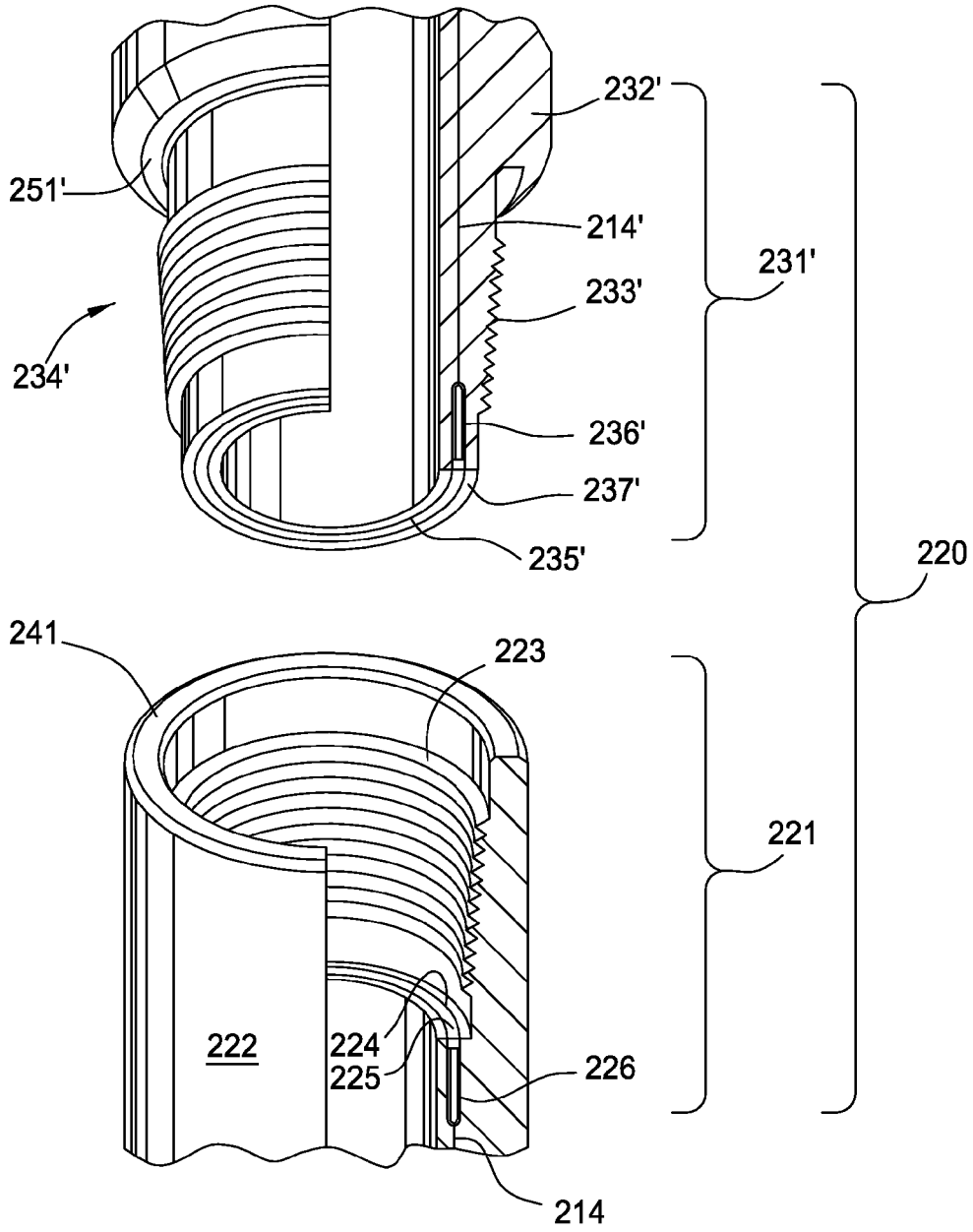
FIG. 4 depicts a partial cut-away, perspective view of a pair of data transmission elements located within a double-shouldered drill pipe.

One type of WDP, as disclosed in U.S. Pat. No. 6,641,434 by Boyle, et al. and assigned to Schlumberger Technology Corp., uses inductive couplers to transmit signals across the WDP joints. An inductive coupler in the WDP joints, according to Boyle, et al., comprises a transformer that has a toroidal core made of a high permeability, low loss material such as Supermalloy (which is a nickel-iron alloy processed for exceptionally high initial permeability and suitable for low level signal transformer applications). A winding, consisting of multiple turns of insulated wire, coils around the toroidal core to form a toroidal transformer. In one configuration, the toroidal transformer is potted in rubber or other insulating materials, and the assembled transformer is recessed into a groove located in the drill pipe connection. FIGS. 3-5 provide an example of the inductive toroidal coupler according to Boyle, et al.

Figure 2:
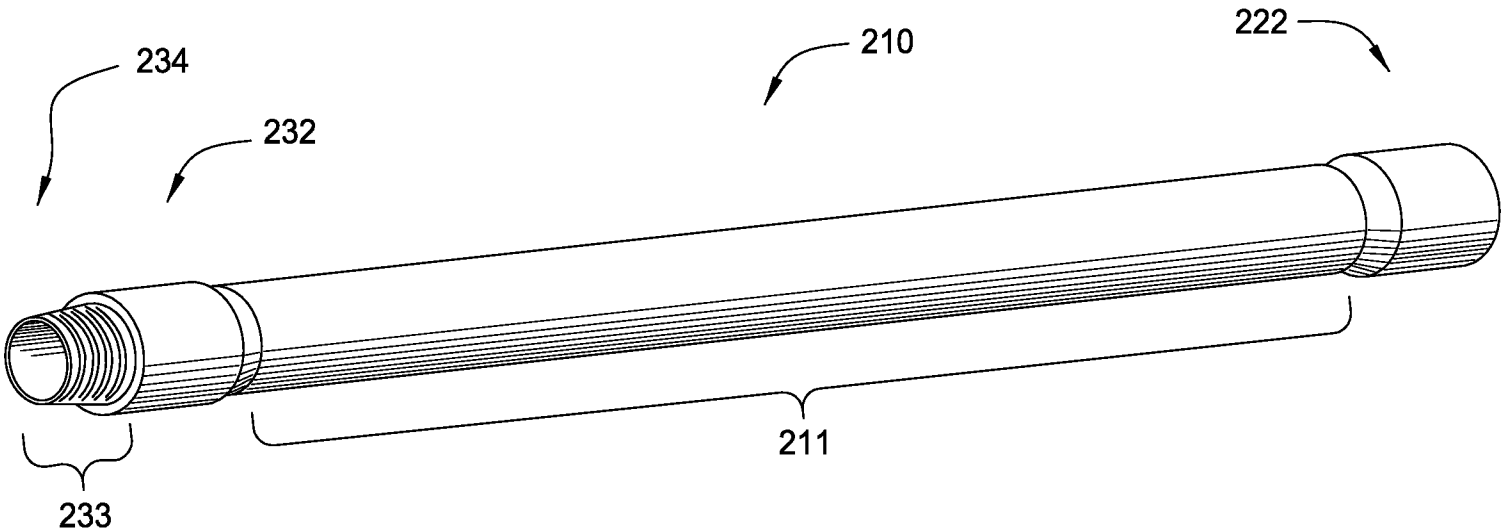
FIG. 2 depicts a perspective view of conventional drill pipe.

FIG. 2 depicts a perspective view of one example of a downhole component, a conventional drill pipe 210. The drill pipe 210 is shown having a box end tool joint 222, a pin end tool joint 232, a pin nose 227, and an elongate generally tubular body 211. Tool joints are attached to the drill pipe 210 or other downhole components and provide threads, such as external threads 233 on the pin nose 227, or other devices for securing drill pipe, tools, or other components, and to allow torque to be applied to resist the forces present when making up a drill string or during drilling. Between the pin end 232 and the box end 222 is the elongate, generally tubular body 217 of the drill pipe section. A typical length of the body is between 10 and 90 feet and usually about 30 feet. Drill strings in oil and gas production and exploration can extend as long as 20,000 feet, which means that as many as 700 sections of drill pipe 210 and other downhole components may be used in the drill string.

FIGS. 3-5 depict various views of a WDP using a double shouldered tool joint connection. FIG. 3 depicts a cross-sectional view of WDP joint 210 connected in a drill string and FIG. 4 depicts a partial cut-away, perspective view of a pair of data transmission elements located within a double-shouldered drill pipe. WDP joint 210 is shown to have data coupling regions 221, 231 which may include data transmission elements at or near the respective box end shoulder 241 of box end 222 and the pin nose 234 of pin end 232 thereof. A first electrical conductor 214 extends through a conduit 213 to connect the data coupling regions 221, 231. The electrical conductor 214 may be, for example, a cable.

The WDP joint 210 is equipped with an elongated tubular body 211 having an axial bore 212, a box end 222, a pin end 232, and a first electrical conductor 214 running from the box end 222 to the pin end 232. A first data transmission element 226 and a second data transmission element 236 are disposed at the box end 222 and the pin end 232, respectively. The first data transmission element 226, the second data transmission element 236, and the first electrical conductor 214 collectively provide a communication system across the length of each WDP joint. When two data transmission elements come together, they form a data transmission connection 220 at the coupled interface between two WDP joints, which data transmission connection 220 may be constituted by a first data transmission element 226 from WDP joint 210 and a second data transmission element 236' from the next tubular member, which may be another WDP joint.

FIG. 5 depicts a sectional view of a pair of data transmission elements facing each other in a pair of double shouldered drill pipe connected together as part of a drill string in greater detail, such as the data transmission connection 220 of FIG. 3. In these embodiments, the data transmission elements comprise inductive couplers. Box end 222 includes internal threads 223 and an annular inner contacting shoulder 224 having a first slot 225, in which a first data transmission element 226 is disposed. The first data transmission element 226 is connected to the first electrical conductor 214. Similarly, pin-end 232' of an adjacent WDP includes external threads 233' and an annular pin nose 234' having a face 237' that has a second slot 235' in which a second data transmission element 236' is disposed.

The second data transmission element 236' is connected to a second electrical conductor 214' of the adjacent WDP 9*a*. The slots 225 and 235' may be clad with a high-conductivity, low-permeability material (e.g., copper) to enhance the efficiency of the inductive coupling. When the box end 222 of one WDP joint is assembled with the pin end 232' of the adjacent WDP, a data transmission connection is formed. FIG. 5 thus shows a cross section of a portion of the resulting interface, in which a facing pair of data transmission elements 226, 236' are coupled together to form a data transmission connection within an operative communication link. This cross-sectional view also shows that the closed toroidal paths 240 and 240' enclose the toroidal transformers 246 and 256', respectively, and that the conduits 213 and 213' form passages for internal electrical conductors 214 and 214' that connect the two inductive coupler elements disposed at the two ends of each WDP joint.

The above-described data transmission elements are inductive couplers that incorporate an electric coupler made with a dual toroid. The dual-toroidal coupler may use inner shoulders of the pin and box ends as electrical contacts. The inner shoulders are brought into engagement under extreme pressure as the pin and box ends are made up, assuring electrical continuity between the pin and the box ends. Currents are induced in the metal of the connection by means of toroidal transformers placed in slots. At a given frequency (for example 100 kHz), these currents are confined to the surface of the slots by skin depth effects. The pin and the box ends constitute the secondary circuits of the respective transformers, and the two secondary circuits are connected back to back via the mating inner shoulder surfaces. While FIGS. 3-5 depict certain data transmission element types, a variety of couplers may be used for transmitting a signal across interconnected tubular members.

Figure 6:
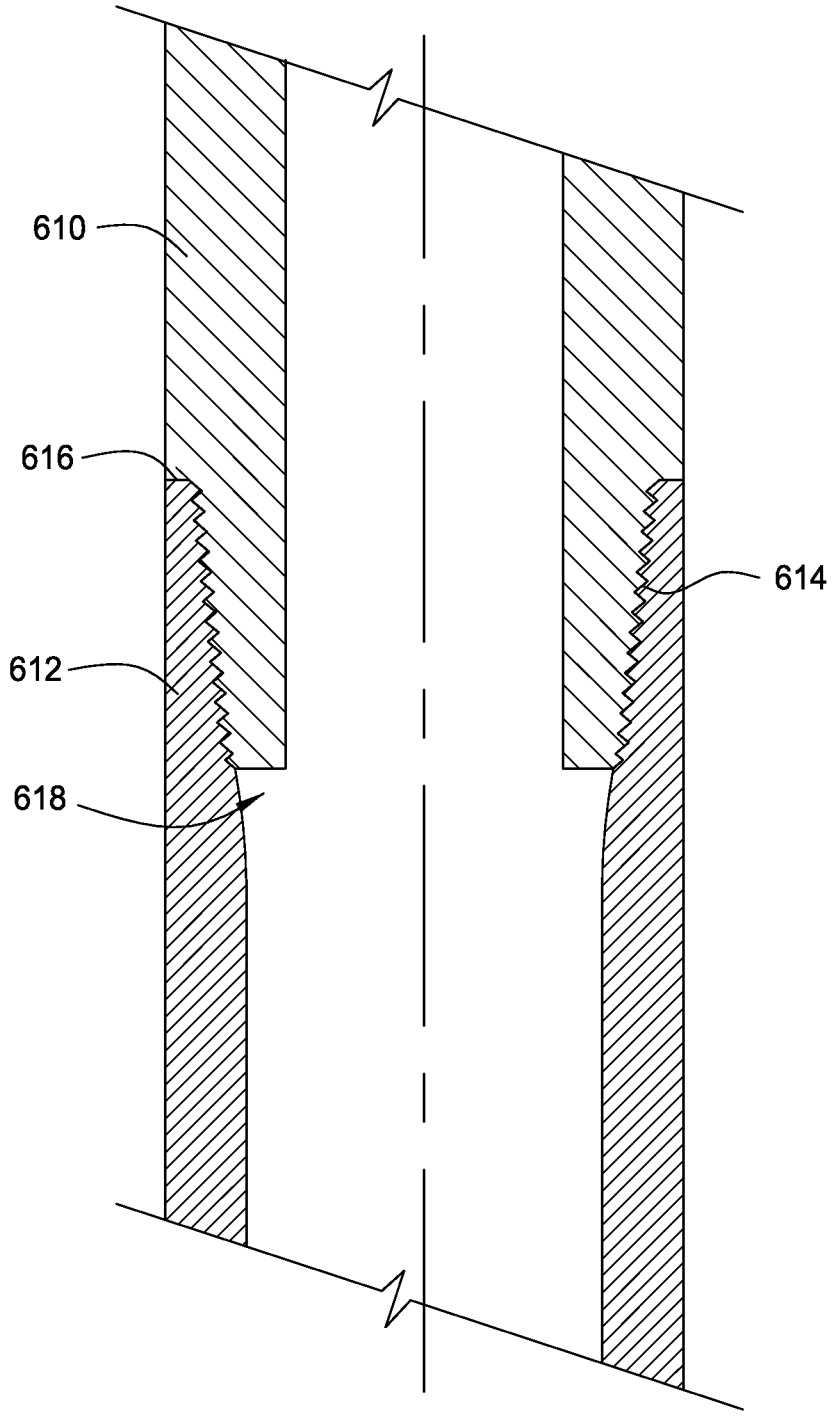
FIG. 6 depicts a cross sectional view of a conventional single shouldered drill pipe.

The above-described WDP uses a double shouldered connection to create the data transmission connection, where a primary and a secondary shoulder become load bearing shoulders when the tool joints are connected together under high torque. However, tubulars may comprise non-double shouldered connections, such as single shouldered connection or wedged type connections. Some examples of single shouldered connections include API or ACME type connections. FIG. 6 depicts a cross sectional view of a single shouldered drill pipe. A box end 612 and pin end 610 have threads 614 mated together during make up of the tool joint. Each box end and pin end have a single primary shoulder which mate together to become a load bearing shoulder 616. Without a secondary, internal shoulder, such as would normally be located in area 618, transforming the non-double shouldered tool joints to house a data transmission element to form WDP connections becomes difficult if not impossible.

Embodiments of present invention relate to the transmission of data between non-double shoulder connections of downhole tools or downhole components, e.g. tubulars that do not have both a primary and secondary load bearing shoulder connection in the tool joint region of the downhole tubular. Generally, the present invention includes a system for transmitting data across a tool joint connection and in particular across non-double shouldered connections. This may be particularly useful in the BHA elements that do not typically come with double shouldered connections.

In one embodiment, the system includes a first data transmission element connected to a first downhole component and a second data transmission element connected to a second downhole component. In various embodiments, the data transmission elements may be either directly or indirectly connected to the downhole components. The system also includes a biasing element biasing at least one of the first and second data transmission elements towards the other data transmission element such that the first and second data transmission elements are in data communication with each other. In some embodiments of the invention, the first and second downhole components may be housing sleeves, chassis, drill pipes, drill collars, saver subs, cross-over subs, jars, and reamers, or various combinations thereof.

In another embodiment, a method of transmitting data across a tool joint connection includes connecting a first data transmission element on a first downhole component and connecting a second data transmission element on a second downhole component. The method also includes biasing the second data transmission element towards the first transmission element and transmitting data between the first and second data transmission elements. The data transmission elements according to the method may be inductive couplers, toroidal couplers, and direct connect couplers. A more detailed discussion of these various embodiments will be discussed below with reference to FIGS. 7-14.

Figure 7:
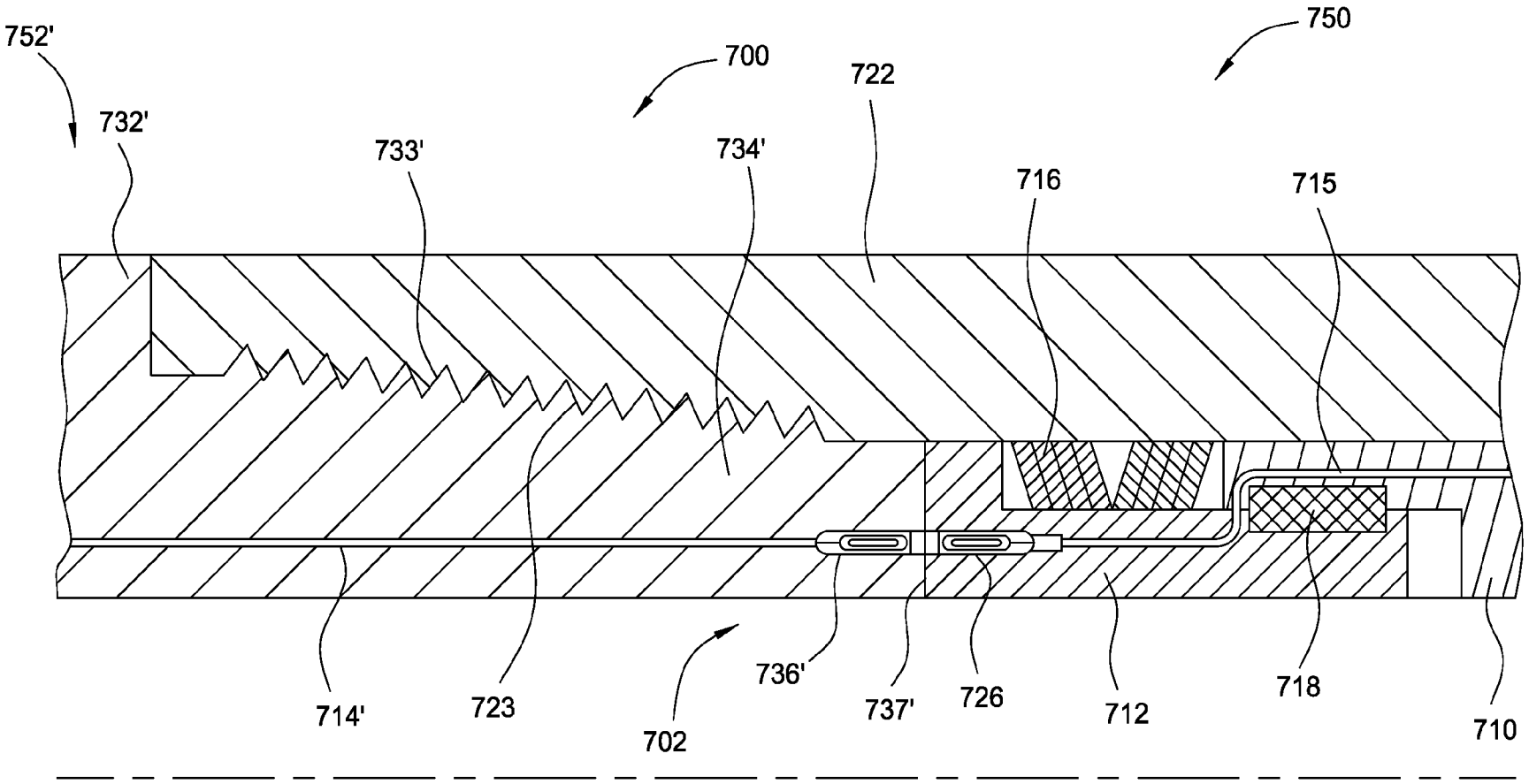
FIG. 7 depicts a cross sectional view of a system for transmitting data across a tool joint connection according to one embodiment of the present invention.

FIG. 7 depicts a cross sectional view of a system 700 for transmitting data across a tool joint connection according to one embodiment of the present invention. A box end 722 includes internal threads 723 but no annular inner secondary contacting shoulder. The box end 722 is mated with a pin end 732' of an adjacent WDP 752' having external threads 733' forming a non-double shouldered connection 702. The pin end 732' also has an annular pin nose 734' and pin nose face 737' in which a first data transmission element 736' is located. In this embodiment, an inductive coupler type of data transmission element 845' is illustrated, further examples of which are shown in FIGS. 9, 10, 11, and 13. A cable 714' extends through the pin nose 734' and the tubular body (not shown) electrically connecting the first data transmission element 736' with another data transmission element at the box end (not shown) of the same downhole component.

To facilitate data coupling across the non-double shouldered connection 702, a chassis 710 is disposed within a second downhole component 750 proximate the box end 722. A second data transmission element 726 is located in a housing sleeve 712 disposed in the box end 722 between the pin end 732 and the chassis 710. A key 718 is a component used to prevent various types of motion between adjacent parts. A key 718 may also be used to align the housing sleeve 712 with the chassis 710. A biasing element 716 is axially disposed between the chassis 710 and the housing sleeve 712. In one embodiment the biasing element may comprise a spring stack or other similar devices used to bias one component towards another component.

The biasing element 716 biases the second data transmission element 726 towards the first data transmission element 736', such that the first and second data transmission elements are in data communication with each other when the pin end 732' and the box end 722 are joined together. The biasing element 716 helps to ensure proper contact pressure, reduce contact resistance, and can be adjusted to make up the required contact pressure and/or ensure proper engagement such as may be desired for a direct connect or flux type data transmission element. An electrical conductor 715 passes through the housing sleeve 712 and chassis 710 and electrically connects the second data transmission element 726 with another data transmission element at the pin end of the same downhole component (not shown).

Figure 8:
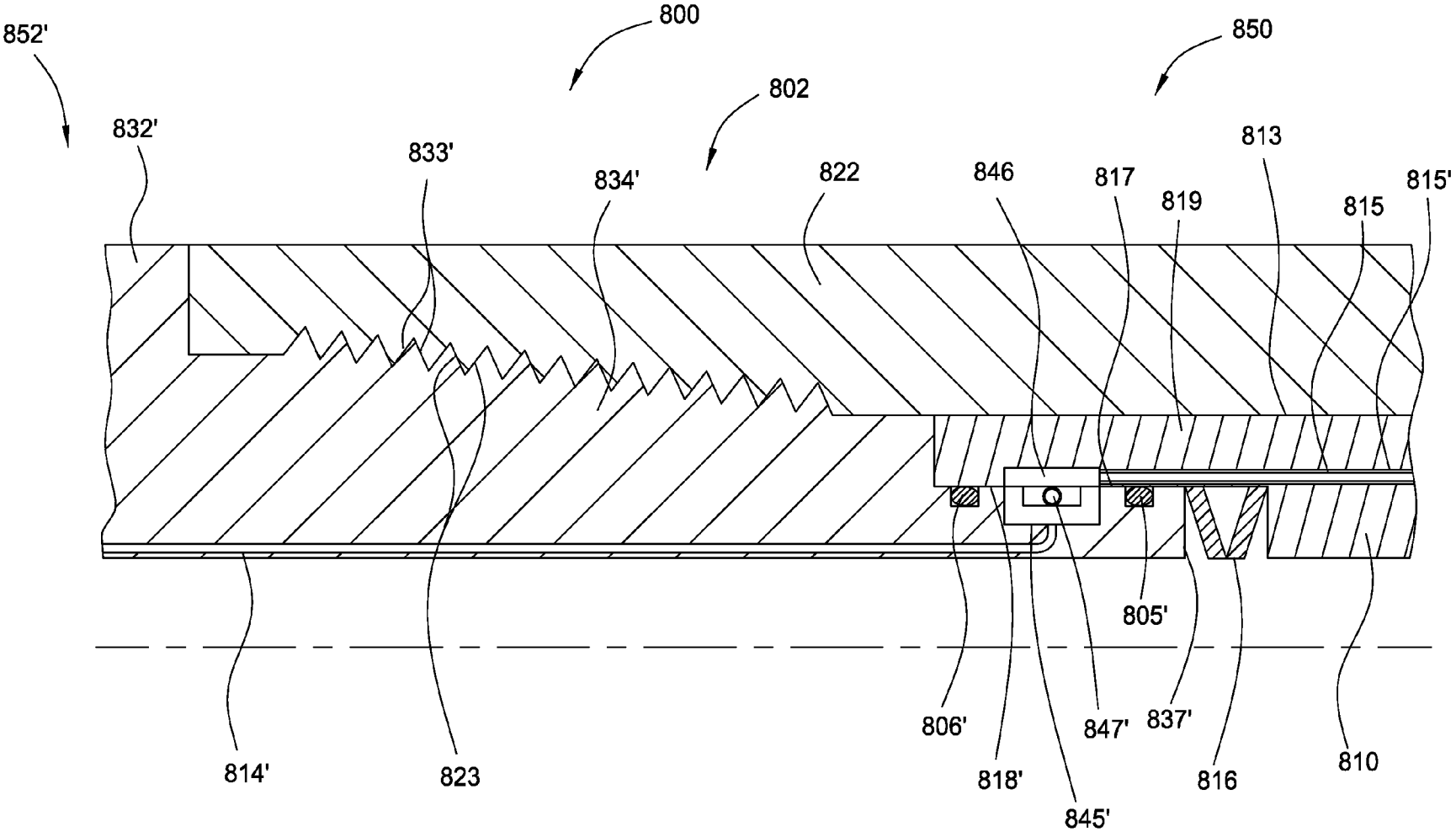
FIG. 8 depicts a cross sectional view of a system for transmitting data across a tool joint connection according to another embodiment of the present invention.
Figure 12A:
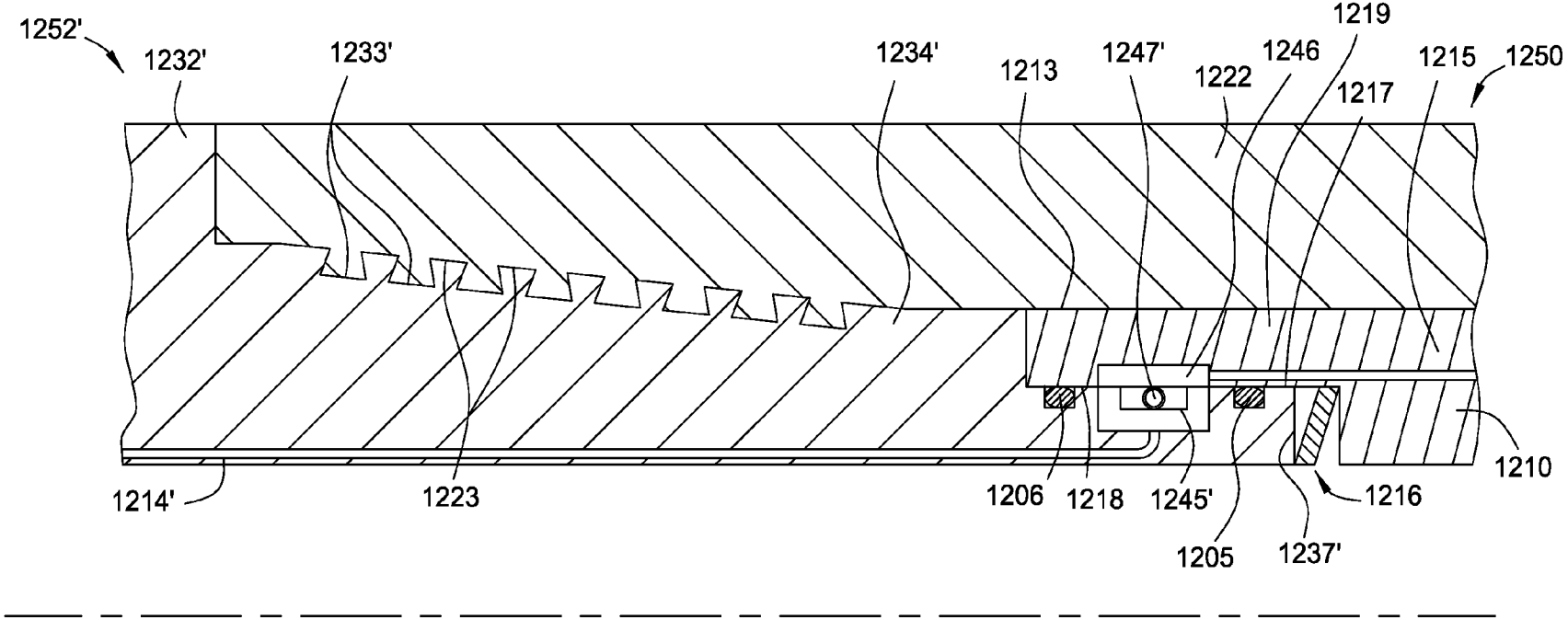
FIG. 12A depicts a cross sectional view of a system for transmitting data across a wedge type tool joint connection according to another embodiment of the present invention.
Figure 12B:
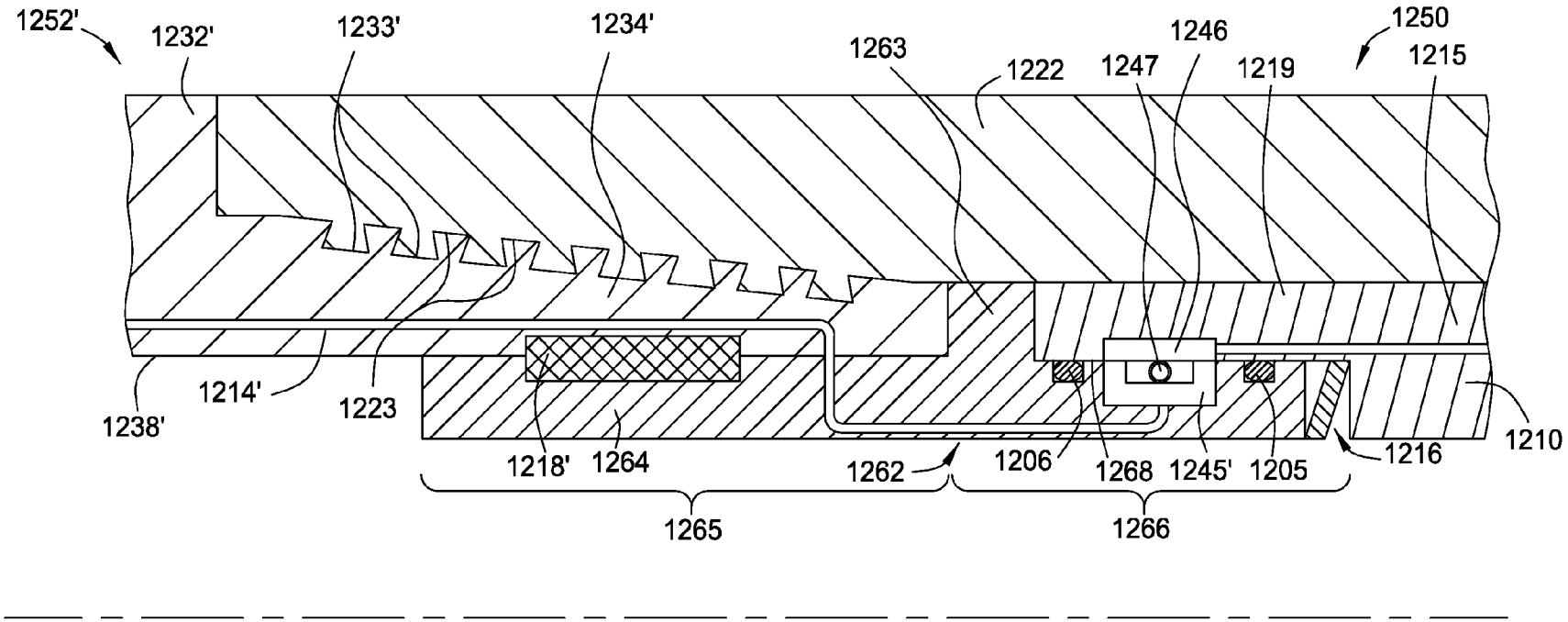
FIG. 12B depicts a cross sectional view of a system for transmitting data across a wedge type tool joint connection according to another embodiment of the present invention.
Figure 14:
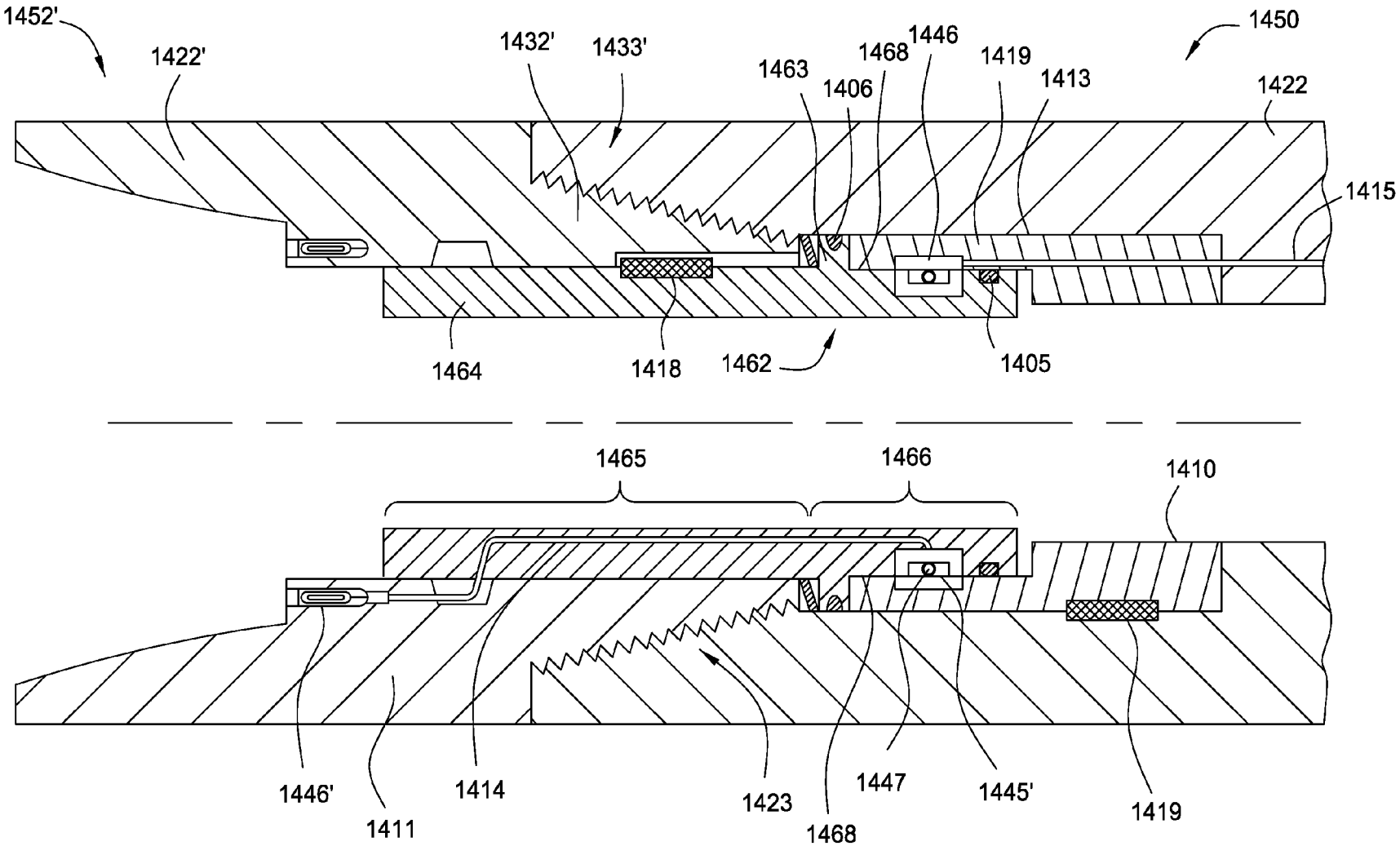
FIG. 14 depicts a cross sectional view of a system for transmitting data across a tool joint connection according to another embodiment of the present invention.

FIG. 8 depicts a cross sectional view of a system 800 for transmitting data across a tool joint connection according to another embodiment of the present invention. A box end 822 includes internal threads 823 but no annular inner secondary contacting shoulder. The box end 822 is mated with a pin end 832' of an adjacent WDP 852' having external threads 833' forming a non-double shouldered connection 802. The pin end 832' also has an annular pin nose 834' and pin nose face 837' in which a first data transmission element 845' is located. In this embodiment, a direct connect coupler type of data transmission element 845' is illustrated where a direct electrical connection is made between the two couplers to transmit a signal, further examples of which are shown in FIGS. 12A, 12B, and 14.

The data transmission element 845' is located on an outer diameter 818' of the pin nose 834' and may house a contact spring 847' to improve direct electrical coupling as the two data transmission elements 845', 846 are coupled together. Seals 805', 806' may be axially located on each side of the data transmission element 845'. A cable 814' extends through the pin nose 834' and the tubular body (not shown) electrically connecting the first data transmission element 845' with another data transmission element at the box end (not shown) of the same adjacent WDP 852'.

To facilitate data coupling across the non-double shouldered connection 802, a chassis 810 is disposed within a second downhole component 850 proximate the box end 822. An annular extension 819 extends from the chassis 810 and is located radially between an inner diameter 813 of the box end 822 and an outer diameter 818' of the pin end 832'. The annular extension 819 may have an inner diameter greater than the inner diameter of the chassis 810 as shown in FIG. 8. A second data transmission element 846 is located in the chassis 810. In this embodiment, the second data transmission element is located on the inside diameter 817 of the annular extension 819. An electrical conductor 815 running through a wire passage 815' in the chassis 810 is electrically coupled with the second data transmission element 846. The system 800 facilitates data communication between the first data transmission element 845' and the second data transmission element 846' when the pin end 832' and the box end 822 are joined together. A biasing element 816 may also be axially disposed between the chassis 810 and the pin end 832' to further facilitate data communication.

Figure 9:
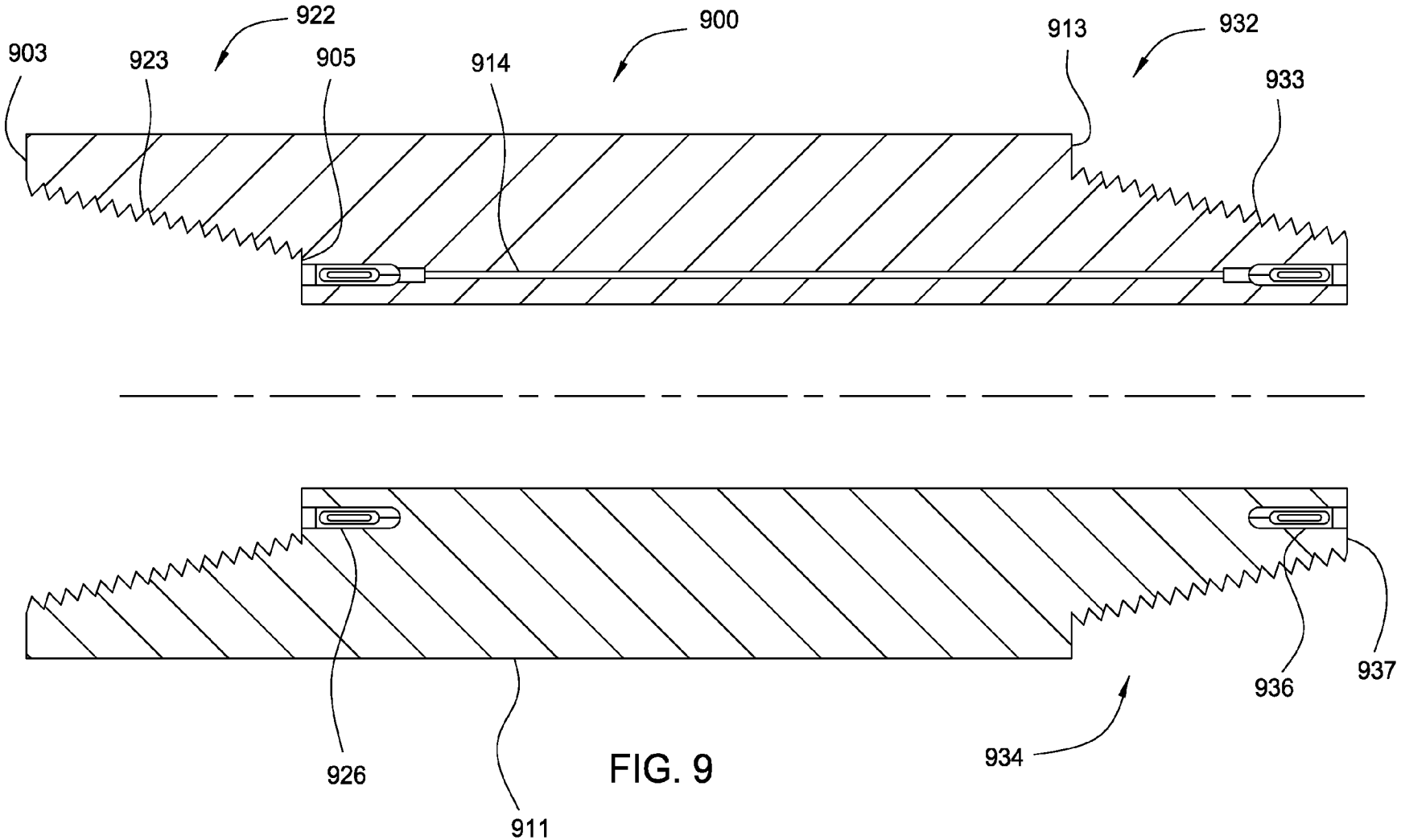
FIG. 9 depicts a cross sectional view of a hybrid wired drill pipe according to another embodiment of the present invention.

FIG. 9 depicts a cross sectional view of a hybrid wired drill pipe according to another embodiment of the present invention. A hybrid wired drill pipe, such as hybrid crossover sub 910, has a box end 922 having internal threads 923 and a premium double shouldered connection whereas the pin end 932 has external threads 933 and is a single shouldered connection. The double shouldered connection includes a primary mating shoulder 903 and a secondary internal mating shoulder 905. The single shoulder connection on the pin end 932 has a primary shoulder 913 for load bearing, but the pin face 937 of pin end nose 934 is not a load bearing shoulder and may mate with a corresponding single shoulder tool joint of a neighboring downhole component (not shown).

In this type of WDP, the data transmission elements 926, 936 are both toroidal inductive couplers with a cable 914 passing through the tubular body 911 and electrically connecting the two data transmission elements. Such a hybrid crossover sub may be used to connect a string of premium double shouldered WDP in a drill string to a BHA section having downhole components with single shouldered connections using various embodiments of the invention, some examples of which are in the following figures.

Figure 10:
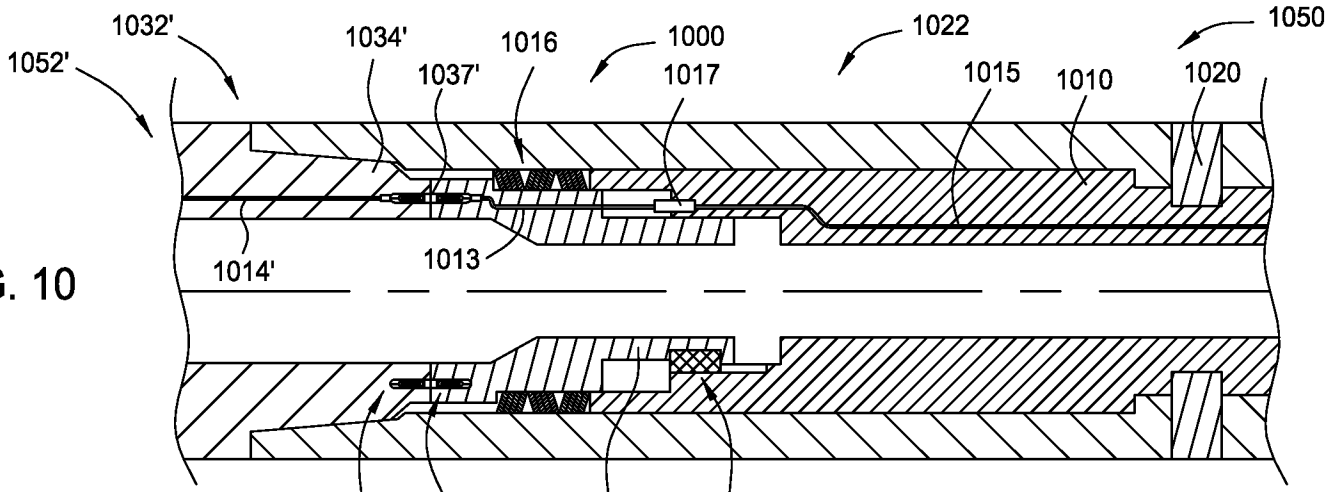
FIG. 10 depicts a cross sectional view of a system for transmitting data across a tool joint connection according to another embodiment of the present invention.

Turning to FIG. 10, a cross sectional view of a system 1000 for transmitting data across a tool joint connection according to another embodiment of the present invention is depicted. In this embodiment, a drill collar 1050 having a box end 1022 is connected to a pin end 1032' of a hybrid cross over 1052' is shown. The hybrid cross over 1052' may be similar to the type depicted in FIG. 9. The box end 1022 includes internal threads 1023, such as API type threads, but no annular inner secondary contacting shoulder. The box end 1022 is mated with a pin end 1032' of an adjacent downhole component, such as hybrid cross over 1052' having external threads 1033' and a single shouldered type connection.

The pin end 1032' also has an annular pin nose 1034' and pin nose face 1037'. A first data transmission element 1036' may be located in the pin nose face 1037'. A cable 1014' extends through the pin nose 1034' and the tubular body (not shown) electrically connecting the first data transmission element 1036' with another data transmission element at the box end (not shown) of the hybrid crossover sub, such as similarly depicted in FIG. 9. A chassis 1010 is disposed within the drill collar 1050 proximate the box end 1022. The chassis 1010 may be coupled to the collar with a key 1020 to hold the chassis 1010 in place within the box end 1022.

A second data transmission element 1026 is located in a housing sleeve 1012 disposed in the box end 1022 between the pin end 1032 and the chassis 1010. In the embodiment depicted in FIG. 10, the data transmission elements 1036' and 1026 are shown as toroidal inductive couplers, though other types may also be used. A key 1018 may be used to align the housing sleeve 1012 with the chassis 1010. A biasing element 1016 is axially disposed between the chassis 1010 and the housing sleeve 1012. In one embodiment the biasing element may comprise a spring stack or other similar devices used to bias one component towards another component.

The biasing element 1016 biases the second data transmission element 1026 towards the first data transmission element 1036' such that the first and second data transmission elements 1026 and 1036' are in data communication with each other when the pin end 1032' of the hybrid crossover 1052' and the box end 1022 of the drill collar 1050 are joined together. The biasing element 1016 helps to ensure proper contact pressure, reduce contact resistance, and can be adjusted to make up the required contact pressure and/or ensure proper engagement such as may be desired for a direct connect or flux type data transmission element.

A housing sleeve electrical conductor 1013 runs through the housing sleeve 1012 and is electrically coupled with the second data transmission element 1026. An electrical connector 1017 electrically couples the housing sleeve electrical conductor 1013 with a chassis electrical conductor 1015 that runs through the chassis 1010. The chassis electrical conductor 1015 is electrically connected to another data transmission element at the pin end (not shown) of the drill collar 1050. The electrical connector 1017 may be a pin-socket type connector, a rotating type connector or a toroidal direct connect type connector. Additionally, an anti-rotation and sealing feature may be needed depending on the connector selection.

Figure 11:
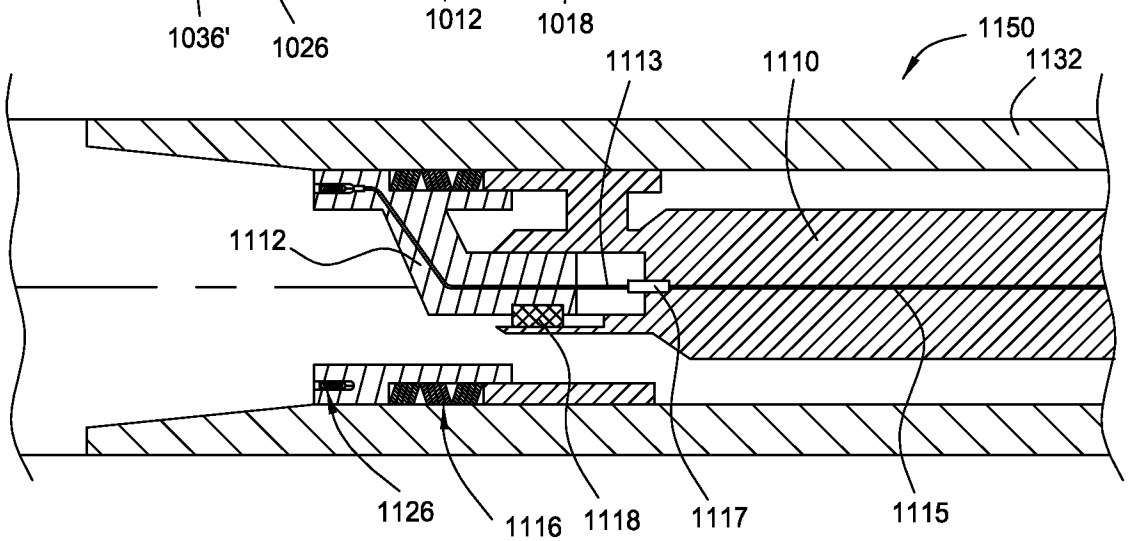
FIG. 11 depicts a cross sectional view of a system for transmitting data across a tool joint connection according to another embodiment of the present invention.

FIG. 11 depicts a cross sectional view of another embodiment of the present invention similar to that shown in FIG. 10. A hybrid crossover sub may be connected to the downhole component 1150 similar to that shown in FIG. 10, though not illustrated in FIG. 11. In this embodiment, a LWD tool box end 1122 connected to a data transmission element 1126 is shown. The chassis is a mandrel type LWD tool where the housing sleeve 1112 is a flow diverter or jamnut. This type of connection may be particularly applicable for the interface sub at the top of LWD/MWD tools. Drilling fluid or mud will be diverted from the center portion of the downhole component 1150 to form a fluid annulus within the downhole component 1150 as it passes by the housing sleeve 1112. Similar features from FIG. 10 are shown in FIG. 11 having similar reference numerals.

A chassis 1110 is disposed within the downhole component 1150 proximate the box end 1122. A data transmission element 1126 is located in a housing sleeve 1112, e.g. a flow diverter or a jamnut, disposed in the box end 1122 between the pin end (not shown) and the chassis 1110. A key 1118 may be used to align the housing sleeve 1112 with the chassis 1110. A biasing element 1116 is axially disposed between the chassis 1110 and the housing sleeve 1112. In one embodiment the biasing element may comprise a spring stack or other similar devices used to bias one component towards another component. The biasing element 1116 biases the data transmission element 1126 towards an adjacent data transmission element (not shown) such that the data transmission elements are in data communication with each other when the pin end of a downhole component (not shown) and the box end 1122 are joined together.

Similar to the embodiment in FIG. 10, a housing sleeve electrical conductor 1113 runs through the housing sleeve 1112 and is electrically coupled with the second data transmission element 1126. An electrical connector 1117 electrically couples the housing sleeve electrical conductor 1113 with a chassis electrical conductor 1115 that runs through the chassis 1110. The chassis electrical conductor 1115 is electrically connected to LWD/MWD tool electronics and could also be connected to another data transmission element at the pin end (not shown) of the downhole component 1150. The electrical connector 1117 may be a pin-socket type connector, a rotating type connector, or a toroidal direct connect type connector. Additionally, an anti-rotation and sealing feature may be needed depending on the connector selection. This embodiment may enable data collected from a LWD/MWD tool having a single shoulder to be transmitted from the BHA and up through the drill string.

FIG. 12A depicts a cross sectional view of a system for transmitting data across a wedge type tool joint connection according to another embodiment of the present invention. Wedge type threads have a unique thread form that totally engages and distributes all the bearing stresses, resisting torsional makeup of the tool joints. Thus, even though tool joints having this thread type may have inner and outer shoulders in some cases, the shoulders are not load bearing shoulders. Rather the threads themselves are load bearing i.e. they resist the stresses associated with high torque make up of tool joints. Various embodiments of the present invention, including some similar to those previously discussed, may be used with wedge type threads to facilitate transmission of data across this unique type of tool joint.

In one example, a second downhole component 1250, such as a repeater collar, has a box end 1222 that includes internal wedge threads 1223 but no annular inner secondary contacting shoulder. Repeaters are placed at regular intervals along the drill string of WDP to strengthen the signal as it is transmitted along the drill string. Thus, the connection at the repeater may need to be equal or better than one between WDP. The box end 1222 is mated with a pin end 1232' of an adjacent WDP 1252' having external wedge type threads 1233' thus forming a wedged thread type connection without double shoulders.

The pin end 1232' also has an annular pin nose 1234' and pin nose face 1237' in which a first data transmission element 1245' is located. In this embodiment, the first data transmission element 1245' is located on an outer diameter 1218' of the pin nose 1234'. The first data transmission element 1245' may also house an electrical contact spring 1247' to improve electrical coupling as the two data transmission elements are coupled together during make up of the tool joints. Seals 1205', 1206' may be axially located on each side of the first data transmission element 1245'. An electrical conductor 1214' extends through the pin nose 1234' and the tubular body (not shown) electrically connecting a first data transmission element 1245' with another data transmission element at the box end (not shown) of the same adjacent WDP 1252'.

A chassis 1210 is disposed within a second downhole component 1250, e.g. a repeater collar, proximate the box end 1222. In this embodiment of the chassis 1210, an annular extension 1219 extends from the chassis 1210. The annular extension 1219 may be located radially between an inner diameter 1213 of the box end 1222 and an outer diameter 1218' of the pin nose 1234'. A second data transmission element 1246 is located in the chassis 1210. In this embodiment, the second data transmission element is located on the inside diameter 1217 of the annular extension 1219. An electrical conductor 1215 running through the chassis 1210 is electrically coupled with the second data transmission element 1246. Data communication between the first data transmission element 1245' and the second data transmission element 1246' is enabled when the pin end 1232' and the box end 1222 are joined together. Additionally, a biasing element 1216 may also be axially disposed between the chassis 1210 and the pin end 1232' to further facilitate data communication.

FIG. 12B depicts a cross sectional view of another embodiment of the present invention for transmitting data across a wedge type tool joint connection similar to that shown in FIG. 12A. In FIG. 12B, a second downhole component 1250, e.g. a repeater collar, has a box end 1222 that includes internal wedge threads 1223 but no annular inner secondary contacting shoulder. The box end 1222 is mated with a pin end 1232' of an adjacent WDP 1252' having external wedge type threads 1233' thus forming a wedged thread type connection without double shoulders.

The pin end 1232' also has an annular pin nose 1234' and pin nose face 1237'. In the embodiment shown in FIG. 12B, a housing sleeve 1262 has a shaft 1264 and an outer ring 1263 along the shaft 1264. An internal portion 1265 of the shaft 1264 is disposed within an inner diameter 1238' of the pin end 1232' such that an external portion 1266 of the shaft 1264 and the outer ring 1263 are disposed outside of and proximate to the pin end 1232'. A first data transmission element, 1245' is located along the external portion of the shaft 1264. In this embodiment, the first data transmission element 1245' is located on an outer diameter 1268 of the shaft 1264. A chassis 1210 is disposed within a second downhole component 1250, e.g. a repeater collar, proximate the box end 1222. In this embodiment of the chassis 1210, an annular extension 1219 extends from the chassis 1210. The annular extension 1219 may be located radially between an inner diameter 1213 of the box end 1222 and an outer diameter 1218' of the pin nose 1234'.

A second data transmission element 1246 is located in the chassis 1210. In this embodiment, the second data transmission element is located on the inside diameter 1217 of the annular extension 1219. An electrical conductor 1215 running through the chassis 1210 is electrically coupled with the second data transmission element 1246. The first data transmission element 1245' may also house an electrical contact spring 1247' to improve electrical coupling as the two data transmission elements are coupled together during make up of the tool joints.

Seals 1205', 1206' may be axially located on each side of the first data transmission element 1245' along the external portion 1266 of the shaft 1264. An electrical conductor 1214' extends through the housing sleeve 1212, the pin nose 1234', and the tubular body (not shown) electrically connecting the first data transmission element 1245' with another data transmission element at the box end (not shown) of the same adjacent WDP 1252'. Data communication between the first data transmission element 1245' and the second data transmission element 1246' is enabled when the pin end 1232' and the box end 1222 are joined together. Additionally, a biasing element 1216 may also be axially disposed between the chassis 1210 and the pin end 1232' to further facilitate data communication.

In the embodiments of FIGS. 12A and 12B, the biasing element 1216 may be used to either generate enough contact pressure for an inductive coupler type data transmission element or to ensure proper make up of a direct connect or flux type coupler. Regardless of the type of data transmission element used, the biasing element 1216 helps bring the data transmission elements together to transmit signals across the tool joins. The repeater connection could be made at a shop or while in the field. Additionally, electrical connectors between the data transmission element and the electrical conductor could be used as required.

Figure 13:
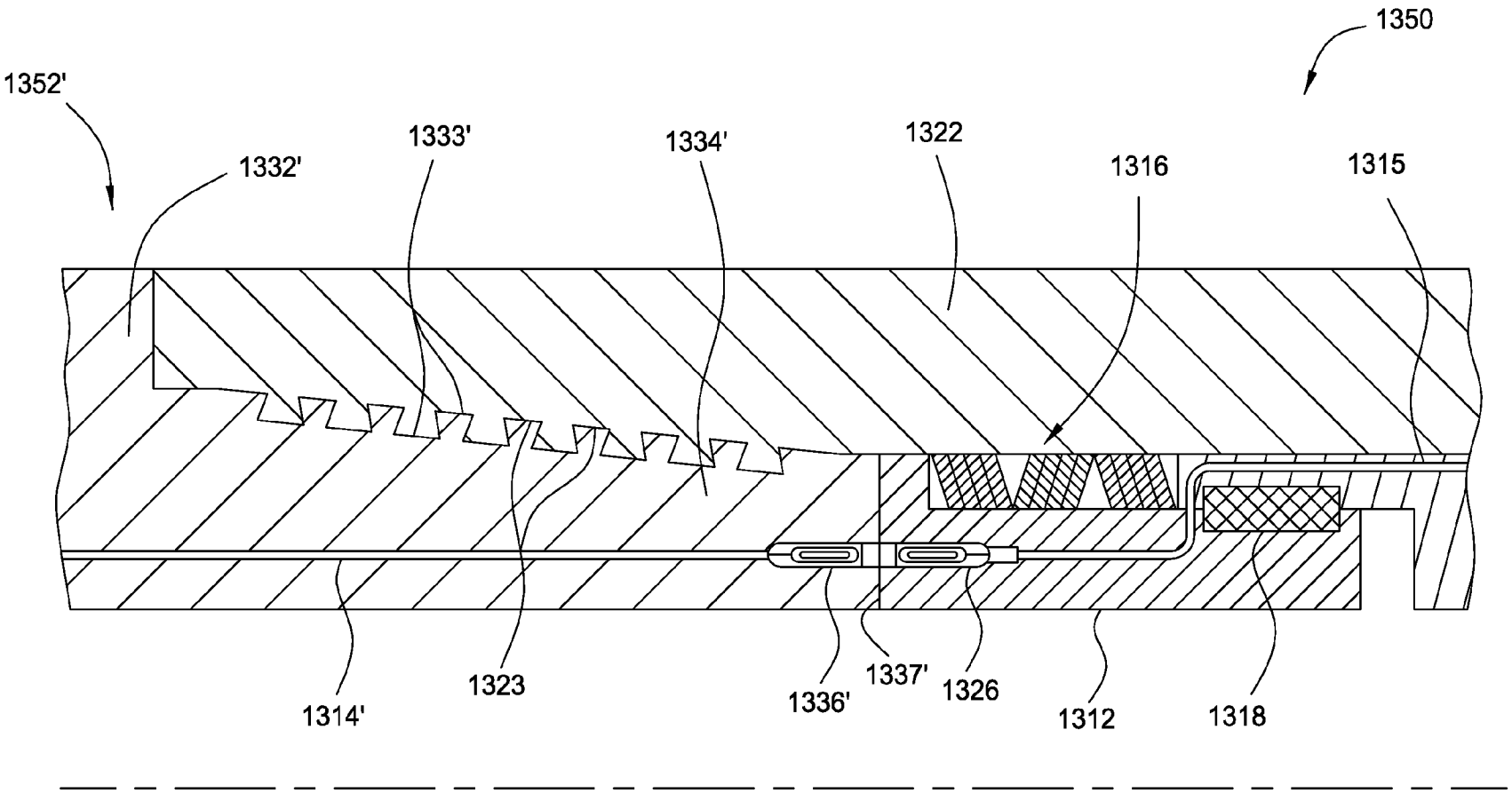
FIG. 13 depicts a cross sectional view of a system for transmitting data across a wedge type tool joint connection according to another embodiment of the present invention.

FIG. 13 depicts a cross sectional view of another embodiment of the present invention for transmitting data across a wedge type tool joint connection, similar to that disclosed in FIG. 7. A repeater 1350 having a box end 1322 includes internal wedge type threads 1323 but no annular inner secondary contacting shoulder. The box end 1322 is mated with a pin end 1332' of an adjacent WDP 1352' having external wedge type threads 1333'. The pin end 1332' also has an annular pin nose 1334' and pin nose face 1337' in which a first data transmission element 1336' is located. A cable 1314' extends through the pin nose 1334' and the tubular body (not shown) electrically connecting the first data transmission element 1336' with another data transmission element at the box end (not shown) of the same downhole component.

A chassis 1310 is disposed within a repeater 1350 proximate the box end 1322. A second data transmission element 1326 is located in a housing sleeve 1312 disposed in the box end 1322 between the pin end 1332' and the chassis 1310. A key 1318 may be used to align the housing sleeve 1312 with the chassis 1310. A biasing element 1316 is axially disposed between the chassis 1310 and the housing sleeve 1312. In one embodiment, the biasing element may comprise a spring stack or other similar devices used to bias one component towards another component.

The biasing element 1316 may be used to provide proper contact pressure for optimum electrical efficiency. The biasing element 1316 biases the second data transmission element 1326 towards the first data transmission element 1336' such that the first and second data transmission elements are in data communication with each other when the pin end 1332' and the box end 1322 are joined together. An electrical conductor 1315 passes through the housing sleeve 1312 and chassis 1310 and electrically connects the second data transmission element 1326 with another data transmission element at the pin end of the same downhole component (not shown). An electrical connector (not shown) may be used to facilitate electrical couplings between the portion of the electrical conductor passing through the housing sleeve and the portion passing through the chassis.

FIG. 14 depicts a cross sectional view of another embodiment of the present invention for transmitting data across a tool joint connection. In this embodiment, first downhole component 1452', e.g. a crossover sub, is connected to a second downhole component 1450, e.g. a wired jar. Jars are typically placed in the drill collar section of a drill string and do not require high torque capacity at their connections. A box end 1422 of a second downhole component 1450 has internal API or ACME type threads 1423 and a single shoulder first downhole component 1452' is made up containing a sealed direct connect assembly.

The box end 1422 is mated with a pin end 1432' of the first downhole component 1452' having API or ACME type threads 1433'. The pin end 1432' also has an annular pin nose 1434' and pin nose face 1437'. A housing sleeve 1462 has a shaft 1464 and an outer ring 1463 along the shaft 1464. In one embodiment of the invention, the outer ring 1463 houses a seal 1406. An internal portion 1465 of the shaft 1464 is disposed within an inner diameter 1438' of the pin end 1432' such that an external portion 1466 of the shaft 1464 and the outer ring 1463 are disposed outside of and proximate to the pin end 1432'. A first data transmission element 1445' is located along the external portion of the shaft 1464. In this embodiment, the first data transmission element 1445' is located on an outer diameter 1468 of the shaft 1464. A chassis 1410 is disposed within a second downhole component 1450, e.g. a jar, proximate the box end 1422. In this embodiment of the chassis 1410, an annular extension 1419 extends from the chassis 1410. The annular extension 1419 may be located radially between an inner diameter 1413 of the box end 1422 and an outer diameter 1468 of the shaft 1464.

A second data transmission element 1446 is located in the chassis 1410. In this embodiment, the second data transmission element is located on the inside diameter 1417 of the annular extension 1419. An electrical conductor 1415 running through the chassis 1410 is electrically coupled with the second data transmission element 1446. The first data transmission element 1445' may also house an electrical contact spring 1447' to improve electrical coupling as the two data transmission elements are coupled together during make up of the tool joints.

Seals 1405, 1406 may be axially located on each side of the first data transmission element 1445' along the external portion 1466 of the shaft 1464. A cable 1414' extends through the housing sleeve 1462 and the tubular body 1411 electrically connecting a first data transmission element 1445' with another data transmission element 1446' at the box end 1422' of the first downhole component 1452'. When the pin end 1432' and the box end 1422 are joined together, data communication between the first and second data transmission elements is enabled. Additionally, a biasing element 1416 may also be axially disposed between the pin end 1432' and the outer ring 1463 of the housing sleeve 1462 to further facilitate data communication.

Embodiments of the present invention enable transmission of data across various types of threaded tool joints enabling all types of downhole components within a drill string to become wired drill pipe. The embodiments may be particularly useful for connecting downhole components within the BHA and for connecting the BHA to the rest of the drill string.

While the foregoing is directed to embodiments of the present invention, other and further embodiments of the invention may be devised without departing from the basic scope thereof, and the scope thereof is determined by the claims that follow.

The invention claimed is:

1. A system for transmitting data across a tool joint connection, comprising:
- a first data transmission element connected to a first downhole component having a pin end,
- a second data transmission element connected to a second downhole component having a box end;
- a chassis disposed within the second downhole component proximate the box end;
- a housing sleeve disposed in the box end between the pin end and the chassis, wherein the second data transmission element is located in the housing sleeve;
- a key disposed radially between the housing sleeve and the chassis and configured to prevent relative rotational motion between the housing sleeve and the chassis; and
- a biasing element configured to bias at least one of the first and second data transmission elements towards the other data transmission element such that the first and second data transmission elements are in data communication with each other.

2. The system of claim 1, wherein the first and second downhole components are selected from the group consisting of housing sleeves, chassis, drill pipes, drill collars, saver subs, cross-over subs, jars, and reamers.

3. The system of claim 1, wherein the biasing element comprises a spring.

4. The system of claim 1, wherein the data transmission elements are selected from the group consisting of inductive couplers and direct connect couplers.

5. The system of claim 1, wherein the first data transmission element is located in the pin end.

6. The system of claim 5, further comprising an electrical conductor running through the chassis and electrically coupled with the second data transmission element.

7. The system of claim 5, wherein the biasing element is axially disposed between the chassis and the housing sleeve and the first and second data transmission elements are in data communication with each other when the pin end and the box end are joined.

8. The system of claim 7, further comprising:
- a housing sleeve electrical conductor running through the housing sleeve and electrically coupled with the second data transmission element and with a chassis electrical conductor running through the chassis.

9. The system of claim 8, further comprising:
- an electrical connector electrically coupling the housing sleeve electrical conductor with the chassis electrical conductor.

10. The system of claim 9, wherein the electrical connector is chosen from the group consisting of a pin/socket type connector, a rotating type connector, and a toroidal direct connector.

11. The system of claim 5, wherein:
- a housing sleeve comprises a shaft and an outer ring along the shaft, an internal portion of the shaft disposed within an inner diameter of the pin end such that an external portion of the shaft and the outer ring are disposed outside of and proximate to the pin end, the first data transmission element located along the external portion of the shaft; and an annular extension extends from the chassis and is located radially between the box end and the housing sleeve; and the second data transmission element is located on an inside diameter of the annular extension and wherein the first data transmission element and the second data transmission element are in data communication with each other when the pin end and the box end are joined.

12. The system of claim 11, wherein the outer ring houses a seal.

13. The system of claim 1, wherein the pin is a threaded pin end or the box is a threaded box end is chosen from the group consisting of an API thread type, an ACME thread type, or a wedged thread type.

14. The system of claim 1, wherein the tool joint connection is a single shouldered connection.

15. The system of claim 1, wherein the second downhole component comprises a downhole tool.

16. A system for transmitting data across a tool joint connection, comprising:

a first downhole component having a threaded pin end;

a first data transmission element located on an outer diameter of the pin end;

a second downhole component having a threaded box end;

a chassis disposed within the second downhole component having an annular extension located radially between an inside diameter of the box end and an outer diameter of the pin end;

a second data transmission element located on an inside diameter of the annular extension; wherein the first data transmission element and the second data transmission element radially engage and are in data communication with each other when the pin end and the box end are joined; and a biasing element disposed between the chassis and the pin end, wherein the biasing element is configured to generate contact pressure between the first and second data transmission elements.

17. The system of claim 16, wherein the second downhole component comprises a downhole tool.

18. The system of claim 16, wherein the pin end of the first downhole component and the box end of the second downhole component are joined in a single shouldered tool joint connection.

19. A method of transmitting data across a tool joint connection, comprising:

connecting a first data transmission element to a first downhole component;

connecting a second data transmission element to a second downhole component;

disposing a chassis through a central axis of the second downhole component;

coupling the second data transmission element to a housing sleeve disposed between a pin end of the first downhole component and the chassis;

preventing relative rotational motion between the chassis and housing sleeve by disposing a key radially between the chassis and the housing sleeve;

biasing the second data transmission element towards the first transmission element; and transmitting data between the first and second data transmission elements.

20. The method of claim 19, wherein the data transmission elements are selected from the group consisting of inductive couplers, toroidal couplers, and direct connect couplers.

21. The method of claim 19, wherein the second downhole component comprises a downhole tool.

* * * * *